US010801259B1

(12) United States Patent
Zubay

(10) Patent No.: US 10,801,259 B1
(45) Date of Patent: Oct. 13, 2020

(54) FLEXIBLE HURRICANE WINDOW PANEL INSTALLABLE FROM INSIDE A BUILDING

(71) Applicant: Kenneth Zubay, Boca Raton, FL (US)

(72) Inventor: Kenneth Zubay, Boca Raton, FL (US)

( * ) Notice: Subject to any disclaimer, the term of this patent is extended or adjusted under 35 U.S.C. 154(b) by 231 days.

(21) Appl. No.: 15/904,980

(22) Filed: Feb. 26, 2018

(51) Int. Cl.
*E06B 9/00* (2006.01)
*E06B 9/06* (2006.01)
*E06B 9/52* (2006.01)

(52) U.S. Cl.
CPC ..... *E06B 9/0692* (2013.01); *E06B 9/521* (2013.01); *E06B 2009/005* (2013.01); *E06B 2009/527* (2013.01)

(58) Field of Classification Search
CPC ..... E06B 9/0692; E06B 2009/005; E06B 2009/527; E06B 9/521; E06B 9/581; E06B 2009/583; E06B 9/58; E06B 9/02; E06B 5/116
USPC ..... 160/327, 387, 392, 371; 52/202, 222
See application file for complete search history.

(56) References Cited

U.S. PATENT DOCUMENTS 2,523,383 A * 9/1950 Majkrzak ..... E06B 9/0692 160/378
6,363,670 B1 * 4/2002 Dewitt ..... E06B 9/02 292/137
7,841,377 B2 * 11/2010 Coenraets ..... E06B 9/581 160/268.1
9,145,729 B2 * 9/2015 Spransy ..... E05G 5/003
2003/0159372 A1 * 8/2003 Motro ..... E06B 9/02 52/202
2004/0154242 A1 * 8/2004 Hudoba ..... E06B 9/02 52/202
2007/0227084 A1 * 10/2007 Skobba ..... E06B 9/02 52/202
2008/0127598 A1 * 6/2008 Kallstrom ..... F41H 5/0485 52/656.7

* cited by examiner

*Primary Examiner* — Katherine W Mitchell
*Assistant Examiner* — Jeremy C Ramsey
(74) *Attorney, Agent, or Firm* — Malin Haley DiMaggio & Bowen, P.A.

(57) ABSTRACT

A hurricane panel system on the outside of an opening that can be installed from inside a multiple story building, through an open window without requiring tools of any type or outside assistance. This panel system includes a pliable, fabric, polyester panel that has a pair of parallel, vertical hems each containing a hem cord that are sized in diameter to fit into a pair of parallel, vertical or horizontal tracks connected to the outside of the building adjacent a window. The pliable, fabric panel includes one or more fabric straps that can be used to manipulate the panel in and out of the tracks. One or more locking pins are used to secure the panel in place relative to the tracks.

12 Claims, 10 Drawing Sheets

FLEXIBLE HURRICANE WINDOW PANEL INSTALLABLE FROM INSIDE A BUILDING

BACKGROUND OF THE INVENTION

1. Field of the Invention

This invention relates to a hurricane storm panel to protect openings, such as windows or doors, in a single or multistory building, and particularly to a pliable hurricane protection panel that can be installed from either the inside or outside of the building.

2. Description of Related Art

Low cost storm panels used to protect building openings such as windows, doors, and wall openings, typically installed and removed before and after a storm, are well known in the art. Typically corrugated aluminum or other types of rigid panels can be installed and removed on building exterior wall-mounted brackets (or with fasteners such as wing nuts and bolts on the outside building wall) to protect the opening from wind and rain damage or flying debris that could break the glass. A major problem with the current method of panel installation (such as corrugated aluminum, plastic or fabric panels) is that each panel must be attached from outside the building. Therefore non-impact rated windows above the second floor in a multistory building such as an apartment, hotel or office building are often left unprotected and uncovered due to cost or inaccessibility from the ground level. If storm panels are to be installed on the windows, the installer must work at great heights above the ground, which can be very labor intensive, require special equipment (such as swing scaffolds, high-lifts or extra tall ladders) resulting in dangerous working conditions, high worker's compensation, higher liability insurance and high labor costs for both the installation and panel removal operations. In certain southern and eastern areas of the United States, hurricane season can be six months long. It is not uncommon to have more than one hurricane storm during a hurricane season that can potentially give rise to the necessity of installing and ultimately removing the hurricane panels several times during a hurricane season.

The invention described herein provides an improvement in that a pliable hurricane or storm panel, in accordance with the present invention, can be quickly, safely and economically installed from the inside of the building by using the window opening, located at any floor level, thus eliminating the need to install the storm panels from outside the building or buying expensive impact rated windows. This is a safe, cost-saving and labor-saving device for protecting a window, door or wall opening from a hurricane or other type of storm in a multistory building. The device can also be used effectively for quickly installing protective panels either from the outside of the building for ground level openings or openings that can easily be reached by means of a ladder. This type of panel system in accordance with the invention can also apply to other types of opening protections for purposes of protecting against: insects, solar rays, and intrusion.

SUMMARY OF THE INVENTION

This hurricane protection system is comprised of a pliable fabric panel (made of fabric, plastic or metal mesh) and two side tracks. The side tracks are first permanently mounted on the outside wall, located on opposite sides of the opening to be protected. A pliable, protective, rectangular hurricane panel sized for the opening can then be installed and removed from inside the building. On opposite sides of the fabric panel there are hems that are used to hold the panel to the installed side tracks. Hems can be made in a variety of ways: enclosed hem cords, zippers, Keder Welts or other formed devices. The hems are attached to the parallel, vertical or horizontal edges of the panel and used to add edge thickness to the panel for the purpose of containing the panel within the hem chambers located within the parallel side tracks. The track hem chamber is comprised of an enclosed area with a side slot (facing the center of the panel and opposite track) that extends the full length of the track. The panel hem device includes a hem cord and is physically larger than the opening in the track side slot. The hem device resides and slides within the track hem chamber while allowing the hem device attached panel to extend through the side slot.

Once installed, each panel has both an inside (facing indoors) and outside surface. If the panel is to be installed from the inside, the flexible panel inside surface includes a pair of long, parallel hand-straps, typically attached several inches in and along opposite outer edges of the panel, each long hand-strap extending the full length of the panel from top to bottom. The purpose of the parallel long hand-straps is for manual engagement that allows the user or installer to manually slide the fabric panel along the length of the side tracks. If the same panel were to be installed from the outside, the hand-straps would be facing the outside.

In operation, a set of side tracks would first be permanently mounted on the outside wall vertically adjacent to the window. With the installer on the inside of the building, the installer would open the window to allow access to each outside side track. The panel would then be inserted through the open window towards the outside. The top edge of the panel would then be positioned slightly below the bottom of the side tracks. The top of each of the panel's side hems is then inserted into the opening of the track's hem chamber (located at the bottom of each track). Using the long hand-straps on either side, the panel is then slid into the side tracks in the upward direction. Panel removal requires that the panel to be slid in the downward direction.

To assist in holding the panel when the panel is being positioned, a third and fourth short hand-strap can be installed on the two ends that do not have the long hand-straps. These short hand-straps are oriented perpendicular to the two long hand-straps. These short hand-straps are used to assist in carrying or holding the panel during the installation and removal process.

Another side track variation uses segmented linear tracks installed on the exterior building wall. This variation would be used if the extreme bottoms of the tracks are not convenient for the installation such as when the tracks are located over an external window sill. The segmented tracks are again located on opposite sides of the window opening. Each segmented track has a conveniently placed open space that divides the track into two coaxially, vertically aligned segments that are spaced apart with enough separation at some midway point between the top and bottom of the window so that a fabric panel can be more easily installed into each track. As above, the panel is positioned so that the side hems can be inserted into the track's hem chambers. The long hand-straps are then used to slide the panel in both an upward direction and a downward direction during installation and removal. The difference is that once the panel has been fully inserted into the top set of side tracks (example:

when the tracks are installed vertically), the fabric panel would then be bent outward so as to position the free bottom end of the panel's hem so that it can be inserted into the bottom track's hem chamber. The remaining fabric hems are then fed into the tracks until the entire panel is contained within both sets of side tracks. The same process is true if the side tracks are mounted horizontally.

In both side track configurations, once the flexible fabric panel has been fully inserted into the side track, it can then be locked into place by means of a pair of locking pins (one for each track). Typically, the locking pin is a quick release, rigid, elongated thin cylinder with an extended, spring loaded ball located on the side of the pin's tip that fits into an aperture within the side wall of the hem chamber located within the side track. The spring-loaded ball is compressed when the pin is pushed into the wall aperture. The ball then returns to its prior position when the pin passes through the wall of the track. In that position, the locking pin cannot be removed from the track without exerting force opposite to the insertion direction. Other locking pin configurations might include multiple-tipped devices that can be used with a guide wire or guide rod in lieu of, or combined with, side tracks. The multiple-tip locking device would be inserted through a fixed aperture or hinged so that the locking device would be positioned on both sides of the guide rod or guide wire, thus restricting the slide movement of the panel.

The side hem on each side of the flexible fabric panel has a conveniently located pin-slot that aligns with the hem chamber's locking pin aperture. The pin-slot consists of a portion of the panel edge hem that has been removed at the pin-slot location. This allows free access to the side track's hem chamber locking pin aperture while the remaining panel's hem is located within the hem chamber on both sides of the pin-slot. When the fabric panel is in place, the locking pin is inserted on each side into the track hem chamber locking aperture through the pin-slot, thereby restricting the fabric panel movement within the side track. Because the locking-pin's function is to passively block the panel's hem movement along the length of the track, there is no wind load or stress of any kind placed upon the pin, so there is no additional hurricane certification testing requirement.

There are other side track embodiments that can be used in a similar fashion. For example: a C-channel track, any type of closed extrusion with a side slit, any type of built up enclosure with a side slot, any type of parallel supports with a slot, or two-piece side tracks (i.e. front and back). Like the other embodiments, the fabric panel configuration remains the same and so does the track orientation relative to the opening. Once the fabric panel is in position covering the opening, the installer can then insert each locking pin through the hem's pin-slot into a track aperture located in each side track, thereby locking the fabric's movement within the track. Because the hem's pin-slot would normally be concealed within the side track, a marker would be placed on the panel or track at that location to indicate the track aperture that receives the locking pin.

In the preferred embodiment the fabric panel is constructed of polyester fabric. However, the flexible hurricane panel, in accordance with the invention, can be constructed of various other materials. Additionally, other flexible panels could be used to provide insect screens or solar shades or other flexible window coverings that can be installed or removed by an installer located either inside or outside the building. The panel normally is removed from the same side as it was installed. Example: when installed from the inside, it is removed from the inside.

The parallel tracks that secure the flexible panel to a building include various different types of parallel tracks that can include one-piece extrusion, multiple-section extrusion (i.e. front and back), tubes with a vertical slit, and C-channels. Each type of side track has a common attribute, namely, "hem" chamber or guide device that is designed to engage the edge of a panel and is used to anchor the panel's side to the track or guide device. These "hem" devices can be flexible bolt ropes, chains, Keder Welts, zippers, or other ridged rods or semi-ridged or formed guide devices that can be either stationary or moved along the track or guide to provide end-retention holding for the flexible storm panel or any roll down screen or shutter.

The locking pin works the same manner in all cases. When the screen or shutter is in place, the pin device is inserted at a predetermined location on the side track (example: through the hem slot chamber) which has the effect of blocking the screen or panel from further slide movement within or on the track because the screen or panel cannot travel beyond the locking pin. All screen or shutter wind pressures are resisted by the sidetracks and no pressure is exerted on the locking pin, so additional hurricane panel testing is not required.

The hurricane protective screen panel can be deployed from inside of the building through an open window or door. The door must swing inward or roll to the side such as a sliding glass door. The windows must also open inward (casement windows), slide to the side (horizontal sliders), raise to open (single hung or double hung). When installing from the inside of the building, this system does not work on outward swinging doors, awning windows, outward swinging windows (casement windows), jealousy windows or fixed windows. In all working cases, the installer must be able to access both side tracks. In the case of installing the protective panels from the outside of the building, there are no restrictions on the types of windows or doors that can use this system.

When installing from the inside of the building, single or multiple contiguous openings can be protected as long as the person can access both the leftmost and rightmost sidetracks. Examples: single hung window or single-hung window plus fixed window plus single-hung window, sliding glass windows with both sides of the window can open to provide access to the side tracks. In the case of large openings where it would be difficult to push the panel upwards from the bottom by just using the long hand-straps, a hand tool such as a boat hook can be used to engage the top hand-strap allowing the installer to push the panel upward.

It is the object of this invention to provide a low cost, safe, convenient, and easy method of manually securing an operational window, door, or wall opening located on any floor level of a single or multi-story building (such as residential apartments, hotels and office buildings) with hurricane panels while the installer is located either inside or outside the building.

BRIEF DESCRIPTION OF THE DRAWINGS

FIG. 6 shows a partial cutaway front elevation view of a vertical track segmented opening in perspective that allows the user to install or remove a flexible hurricane panel in the midportion of the track instead of at each end.

PREFERRED EMBODIMENT OF THE INVENTION

Figure 1:
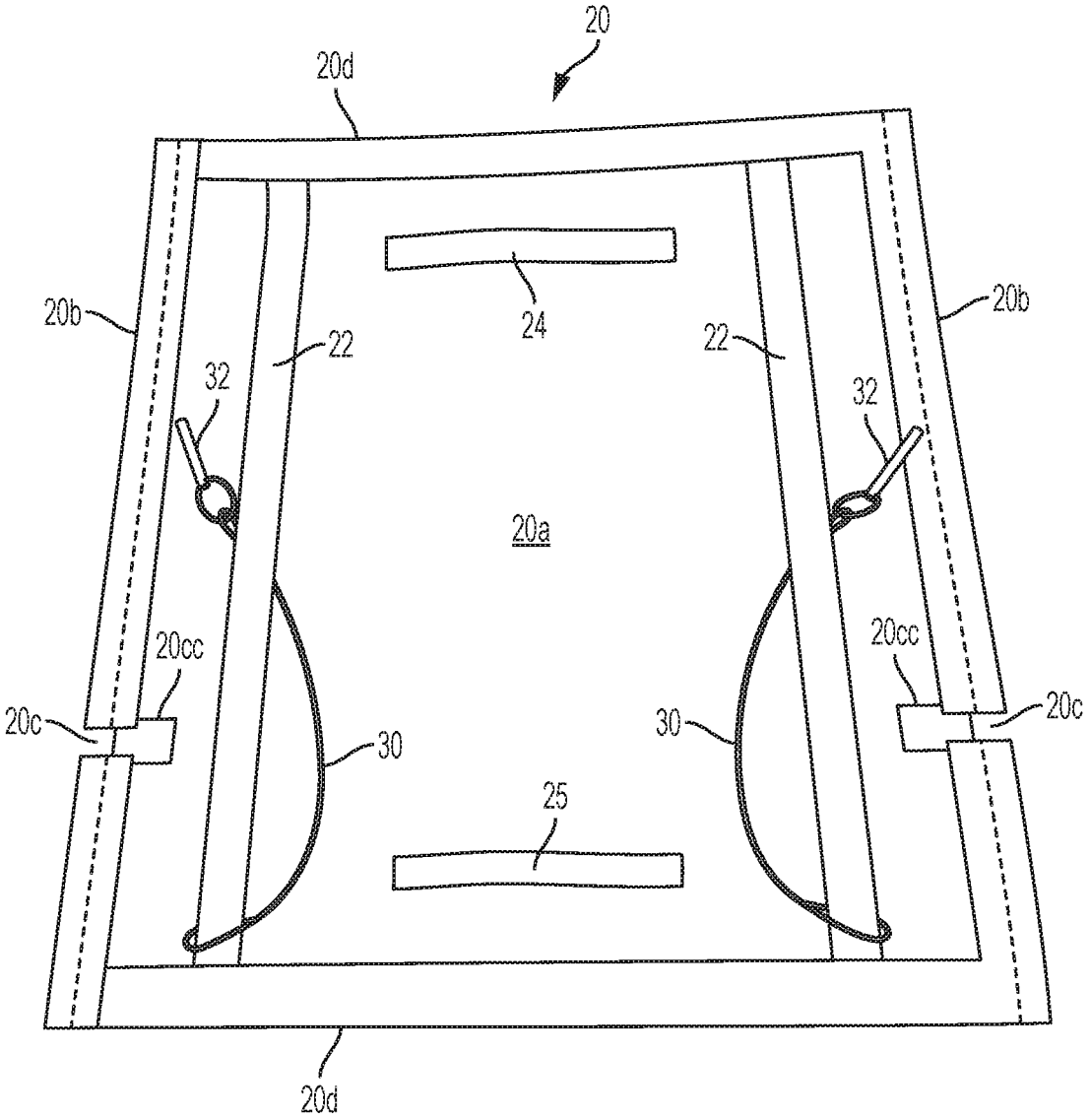
FIG. 1 shows a perspective installer-side view of the flexible hurricane panel used in the present invention. It consists of the fabric panel, side hems (optionally on all 4 sides), long hand-straps, attached locking pins (optionally not attached), short hand straps, pin-slots and pin-slot location indicators.

FIG. 1 shows a flexible fabric storm and hurricane panel 20 that includes a polyester fabric flexible body 20*a* and parallel hems 20*b* on each side of the flexible fabric body 20*a*. The hems 20*b* are separated on each side of the flexible fabric body 20*a* by pin-slots 20*c*. Parallel panel mounting tracks 16 on one side and 18 on the opposite side (FIG. 2) receive (through load points LP) and secure the hurricane panel 20 with hems 20*b* to tracks on a building exterior. The hems 20*b* are wrapped around hem cords (not shown in FIG. 1) to enlarge the panel sides so that the hems 20*b* can be snugly fitted into the vertical parallel side tracks 16 and 18 in FIG. 2.

The flexible fabric panel body 20*a* also has a pair of parallel, vertical long hand-straps 22 attached at each end at top and bottom that can be used to manually manipulate the panel 20 into and out of the mounting tracks. An additional top horizontal short hand-strap 24 and bottom hand-strap 25 are attached at the top end to the fabric body 20*a* as an additional hand-strap for pulling the fabric body into the vertical mounting tracks.

Figure 2:
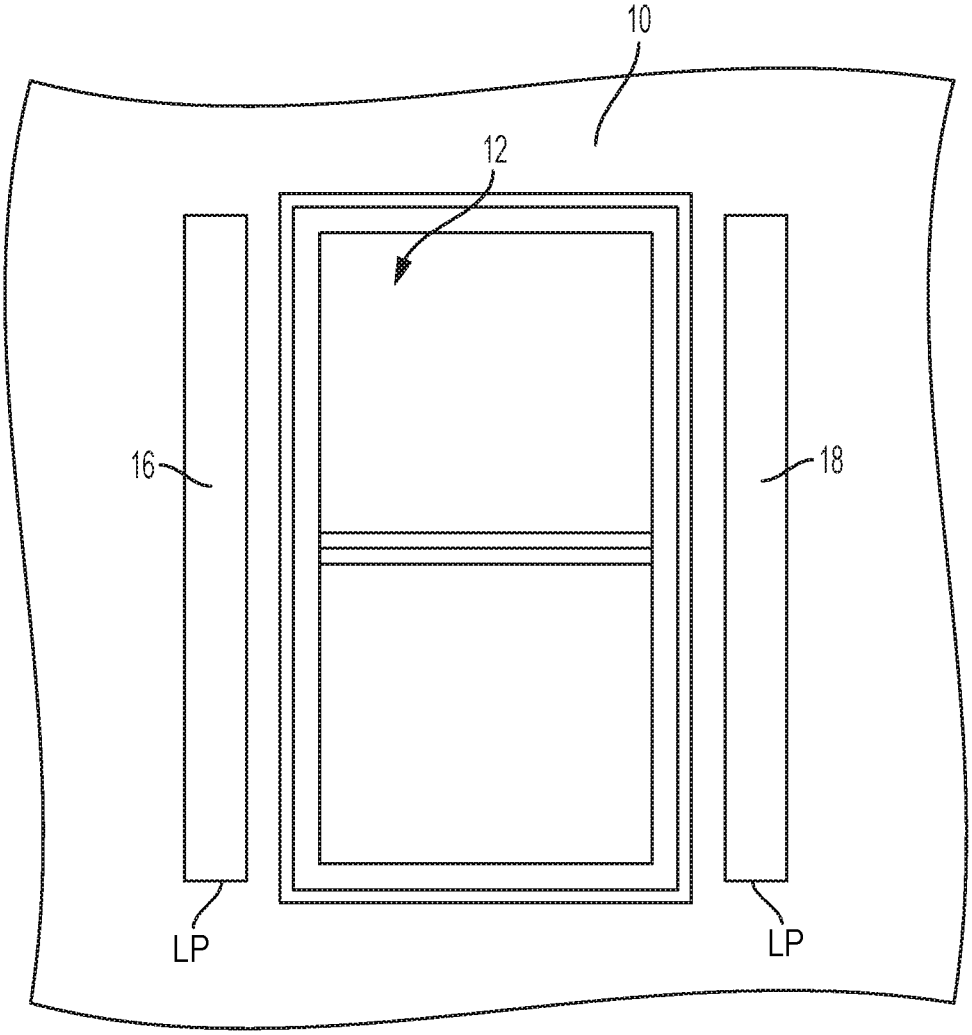
FIG. 2 shows a cutaway view of the exterior of a building disclosing a window and two vertically mounted parallel tracks that can be used to support a flexible hurricane panel (not shown). This drawing also shows that the top of each track that is restricted and the bottom "load point" where the top edge of the hem will be inserted into the track.

The flexible fabric panel hems 20*b* are axially aligned but separated in the middle by pin-slots 20*c* also indicated by a colored marker 20*cc*. The purpose of the hem slots 20*c* are to separate one hem segment from the adjacent hem segment at one side which allows a locking pin 32 to be inserted into the vertical panel mounting tracks through the hem pin-slot 20*c*. The locking pin 32 acts as a hem stop on one side of the panel 20 above and below each hem 20*b*. The locking pin 32 manually inserted into a track wall and through hem pin-slot 20*c* prevents movement of the panel 20 in either direction because the locking pin 32 stops the movement of the hems 20*b* and the panel in either direction when the locking pins 32 are installed into the mounting tracks (not shown in FIG. 1) on each side. Each locking pin 32 can be tethered and connected to the panel 20 by a tethering strap 30 connected on each side to long hand-straps 22. Hems at top and bottom 20*d* are optional for horizontal tracks in lieu of vertical tracks, FIG. 2 shows a cutaway view of a building exterior wall 10 that contains a window 12 that can be opened inwardly or vertically. This configuration is used when the track bottom is easily accessible. For one-piece tracks 16 and track 18, the track hem chamber is accessed (for panel install or removal) from the track bottom end load point LP (if vertically installed). The track top is sealed on each track.

Figure 3:
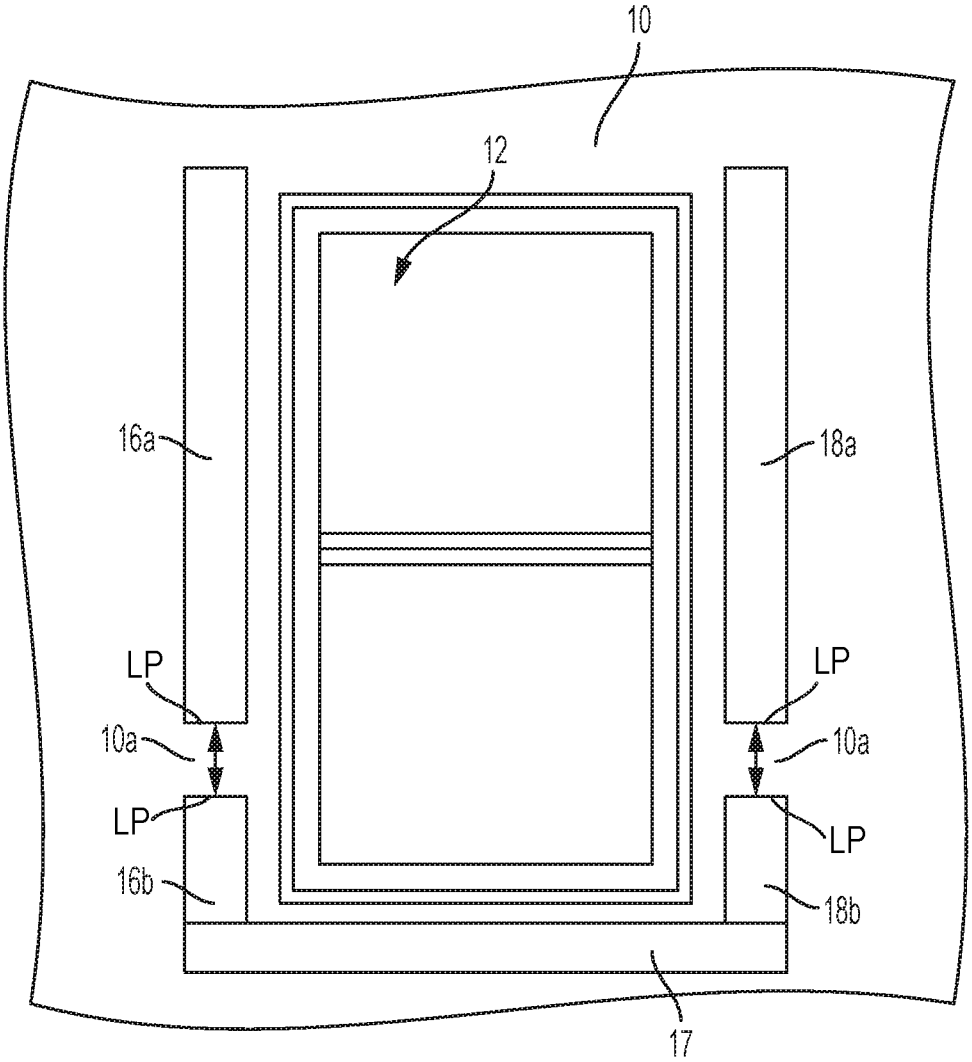
FIG. 3 shows a cutaway view of the exterior of the building having a window and vertical parallel sidetracks with each side track comprising two separated segments that are used to support a flexible hurricane panel (not shown). Note that the side tracks are located right above a fixed point (example: ledge 17) on the building thus blocking the normal lower load in point on the side track. In this configuration there is a bottom load point for the top track, a gap in the tracks and a top load point for the bottom track on each side of the opening. The locking pin location is normally located on the longer track. Another embodiment can be a single side track in such a way as to provide the same effect as to separately aligned side tracks. Example.

FIG. 3 shows a cutaway view of a building exterior wall 10 that contains a window 12 that can be opened inwardly or vertically. This configuration is used when the track bottom or both ends of the track is obstructed. Multi-track segments 16*a* and 16*b* are aligned vertically on one side of the window 12 and track segments 18*a* and 18*b* are aligned vertically on the opposite sides of the window 12 and parallel to track segments 16*a* and 16*b*. The panel mounting tracks 16*a* and 16*b* and 18*a* and 18*b* can be used to receive a flexible hurricane panel in accordance with the present invention as described below. Each of the parallel track axially-aligned segments are separated from each other by a space 10*a* which allows an operator inside the building to install or remove a flexible panel into each of the track segments upwardly and downwardly because of the space 10*a* allowing insertion and removal of the flexible panel ends into each track segment load point LP positioned adjacent to the space 10*a* between the tracks. Both styles of tracks can be used either vertically or horizontally based upon the opening's configuration. A ledge 17 can be used to seal the bottom ends of the tracks 16*b* and 18*b*.

Figure 6:
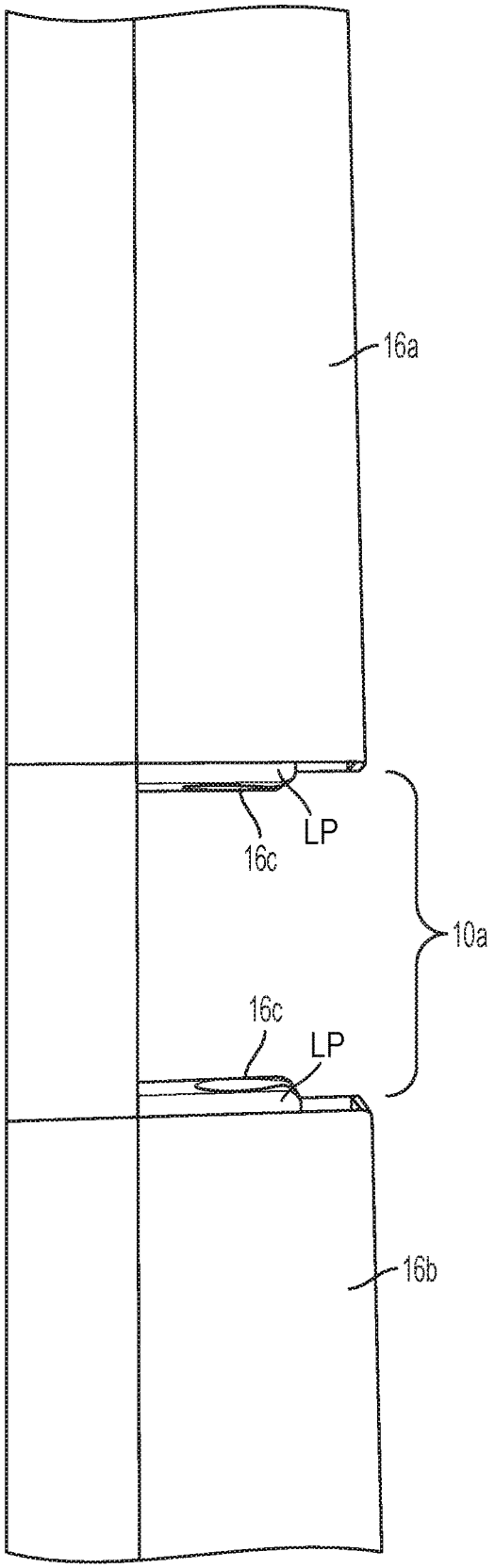
FIG. 6.

FIG. 3 and FIG. 6 show the panel mounting tracks 16*a* and 16*b* and 18*a* and 18*b* are linearly aligned segments separated by a space 10*a* that allows the top end of a flexible hurricane panel hem 20 (FIG. 1) to be installed in the bottom load points (of the upper track segments 16*a* and 18*a*) and the bottom end of the flexible hurricane panel 20 hem into the load point at the top of the lower track segments 16*b* and 18*b*. Once the panel is fully installed into the tracks, it is locked into place by means of the locking pin. Panel removal from the upper tracks and the lower tracks is just the reversal of the installation process. The segmented tracks provide for a convenient panel insertion location.

Figure 4:
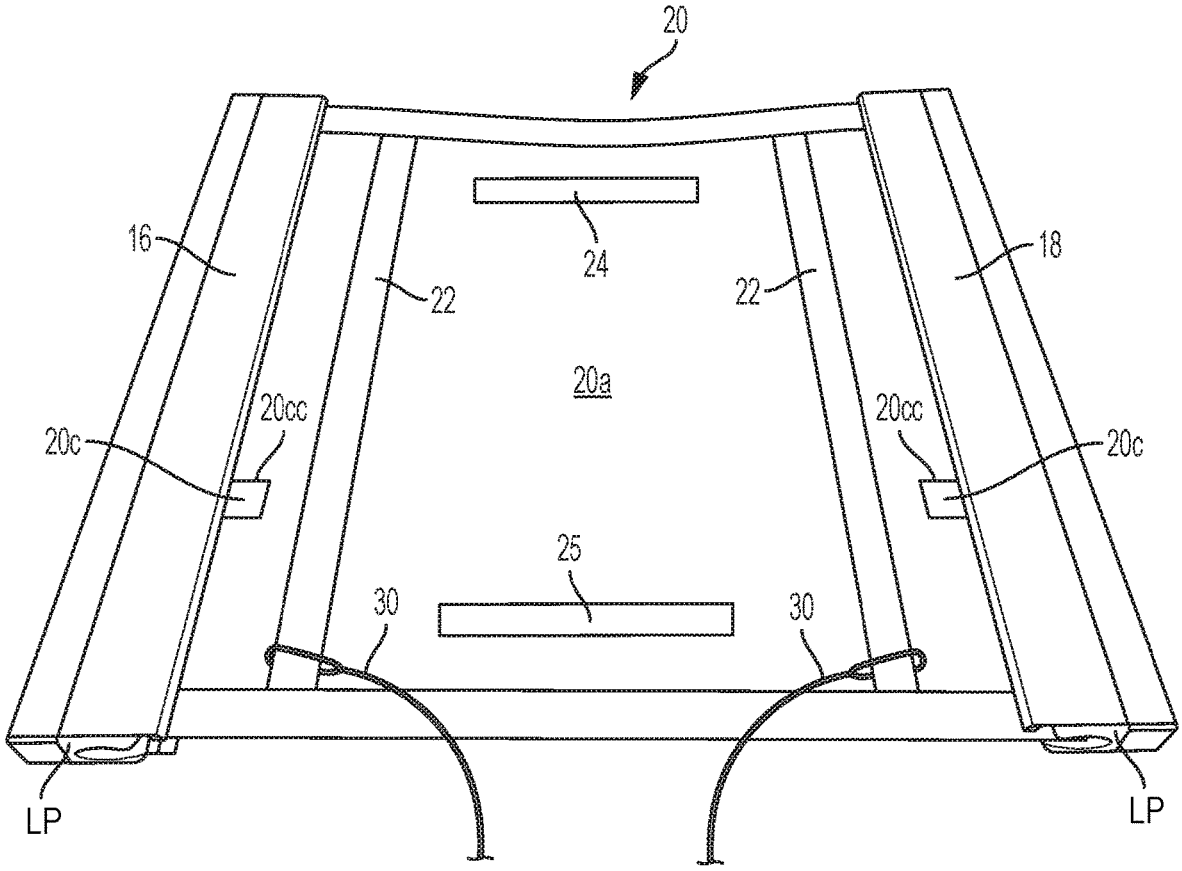
FIG. 4 shows a perspective view of parallel fastening tracks and a flexible hurricane panel with side hems engaged in the tracks. Note the pin-slot indicators.

FIG. 4 shows a flexible fabric hurricane panel 20 mounted and connected to parallel side tracks 16 and 18. The panel hem on each side containing a hem cord is not visible because they are inside the tracks 16 and 18. The parallel side tracks are not shown mounted to a building; however the flexible hurricane panel (as seen from the installation side) is shown including vertical long hand-straps 22 and horizontal short strap 24 and short strap 25 that can be manually engaged by the installer for moving the flexible panel 20 along the vertical tracks 16 and 18 during installation and removal. Once the side tracks are installed on the exterior of a building, the flexible hurricane panel 20 can be installed from either the inside or outside of the building using the bottom load points LP. The locking pins 32 (not shown in FIG. 4) are each connected to tether 30. The tether 30 is in turn connected at one end to the fabric panel.

Figure 5:
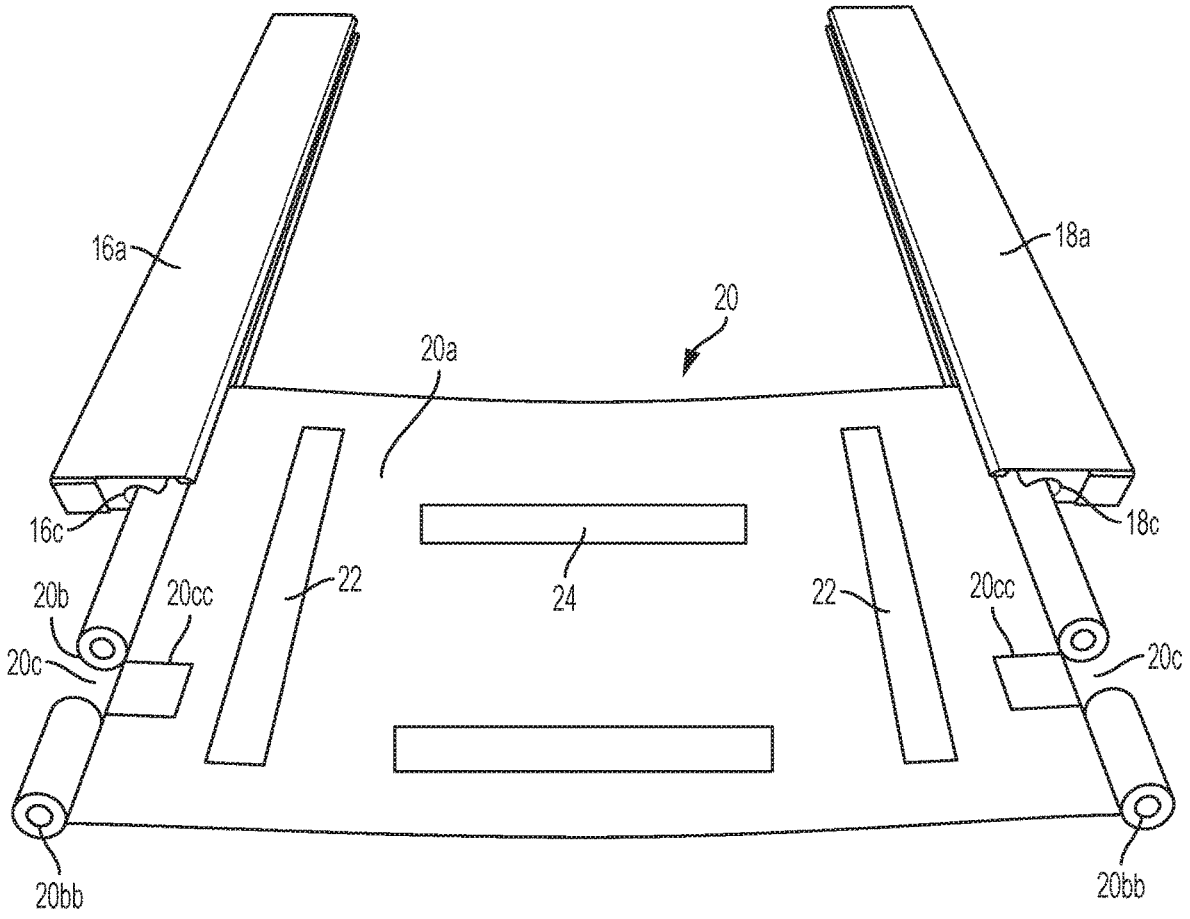
FIG. 5 shows a perspective view partially cutaway of a flexible hurricane panel partially inserted into a pair of parallel fastening tracks.

FIG. 5 shows cutaway view of either a single or segmented track including upper segment track 16*a* and track 18*a* engaging a portion of panel 20 in the track hem chamber (load point) 16*c* and 18*c* which have received hems 20*b* on each side. Each hem 20*b* includes a hem cord 20*bb* that is sewn inside hem 20*b*. Thus the panel 20 is securely fastened to the track segments 16*a* and 18*a* as shown and the panel 20 can be moved manually in either direction along the length of the side track for installation or removal. The cut outs 20*c* in the hem are pin-slots. They are indicated by a contrasting color flag 20*cc* to mark the location where the locking pin should be inserted into the side track.

FIG. 6 shows vertical side track segments 16*a* and 16*b* separated by a space 10*a* that is used by an installer to insert the top hem of a panel into the hem chamber via the track load point 16*c* for track 16*a* and insert the bottom hem into the hem chamber via the load point 16*c* located at the top of the bottom track 16*b*. Therefore an installer does not have to always install the panels at the very bottom of the tracks. They can install and remove the flexible panel at some mid portion load points LP of the tracks which is much more convenient from inside the building.

Figure 7:
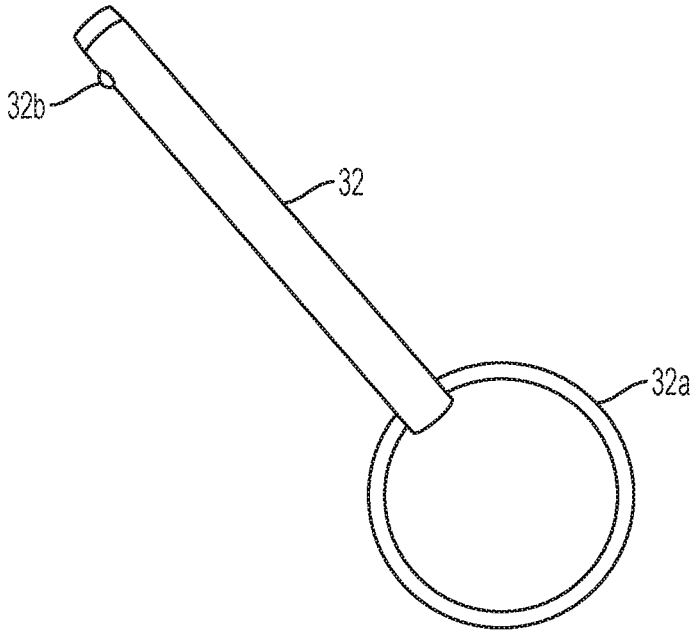
FIG. 7 shows a side elevational view of the locking pin used in the present invention to secure a flexible hurricane panel in place in the parallel tracks.

FIG. 7 shows a quick release locking pin 32 connected to a circular retaining ring 32*a* that includes a spring loaded movable ball and detent 32*b* used to secure the locking pin shaft through a wall aperture of the track that contains the flexible hurricane panel. The locking pin 32 when engaged in the track prevents removal of the flexible hurricane panel when the panel is in place.

Figure 8:
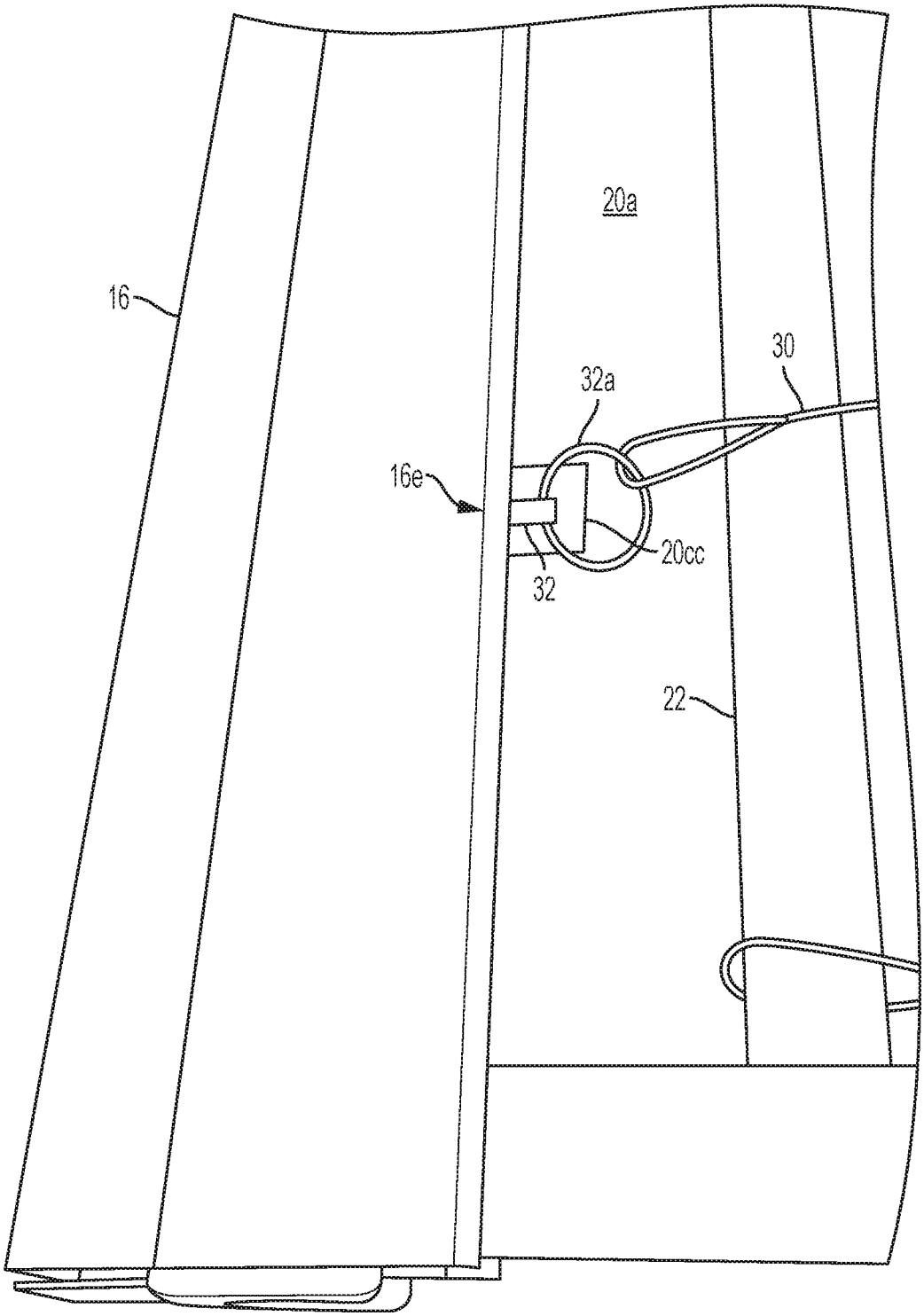
FIG. 8 shows a partial cutaway view and includes a portion of the side track and portion of a flexible hurricane panel mounted within the track in secured with a locking pin.

FIG. 8 shows a cutaway view of both the portion of the flexible hurricane panel attached to a portion of the parallel track 16. FIG. 8 shows how the locking pin insert location is identified by means of the pin fabric panel location flag marker 20*cc*, how the locking pin 32 is connected to vertical track 16 through an aperture in a wall of the vertical track (not shown). The locking pin 32, when in place, is positioned between the upper and lower edges of pin-slot 20*c* in the flexible hurricane hem 20*b* shown in FIG. 1. Once the installer has attached the flexible hurricane panel 20 between two parallel vertical tracks from top to bottom of the hurricane panel 20, the installer inserts the locking pin 32 into each parallel side track 16 and 18. A locking pin black arrow marker 16*e* (placed on the track 16 or 18) or locking pin marker (20*cc* placed on the panel 20) indicates the location of the hem slot 20*c* inside the hurricane panel 20 as shown in FIG. 1. The locking pin markers 16*e* or 20*cc* are necessary because once the flexible hurricane panel has been installed into the side track, the hem slot 20*c* is no longer visible, so that a track locking pin markers 16*e* or 20*cc* are necessary to determine where the locking pin needs to be inserted into the track 16 to prevent removal of the hurricane panel 20.

Figure 9:
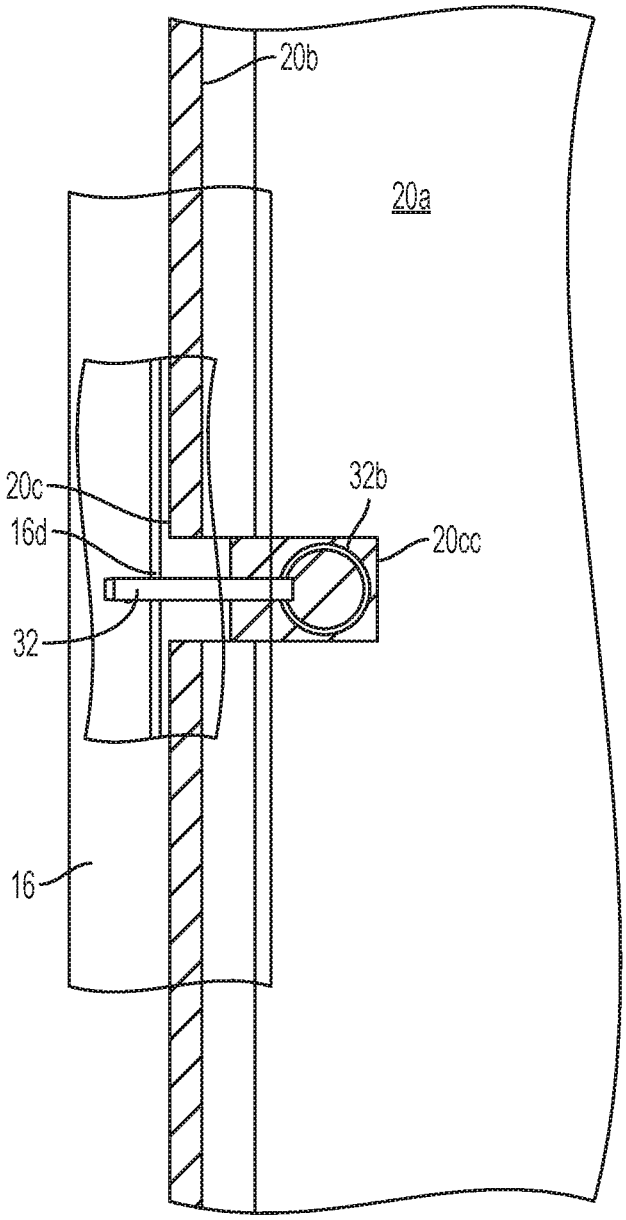
FIG. 9 shows a partial cutaway elevational view of a portion of the flexible hurricane panel and a portion of the fastener track that itself has a cutaway view showing the locking pin in place securing the flexible hurricane panel.

FIG. 9 shows the locking pin 32 inside a track wall aperture 16*d* and mounted between the flexible hurricane panel hem 20*b* and the hem slot 20*c*. The locking pin 32 (shown in FIG. 7) is mounted in track wall aperture 16*d* manually and the locking pin 32 is removed using the circular retainer 32*b*. The fabric location marker 20*cc* is colored to indicate location for the pin.

Figure 10:
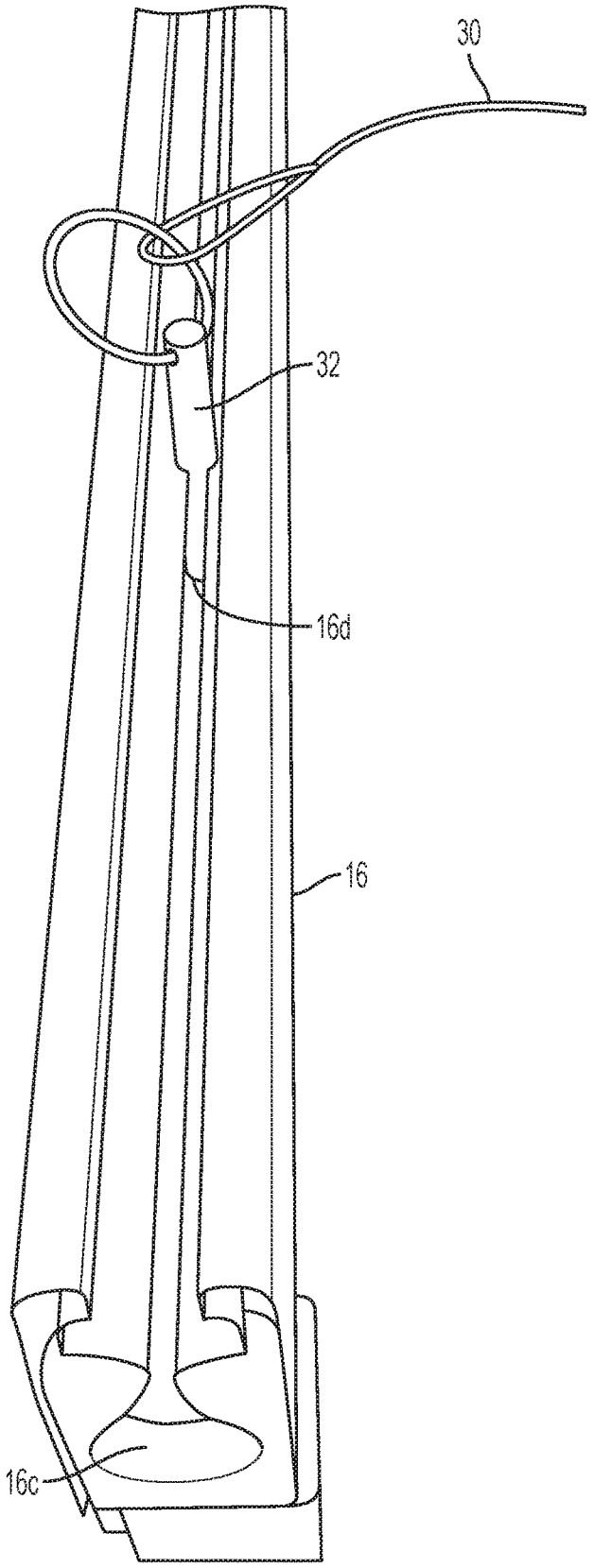
FIG. 10 shows a perspective view partially cutaway of track to show the locking pin in place secured to the track. The locking pin is inserted far enough to allow the locking pin's detent ball to extend past the inner track wall.

FIG. 10 shows a view of a side track 16 used to mount and connect to the flexible hurricane panel (not shown in FIG. 10). The locking pin 32 is received down through hem channel 16*c* that receives the hem and hem cord of the flexible hurricane panel (not shown in FIG. 10). The track wall aperture 16*d* receives the locking pin 32 which is used with a hurricane panel installed in the side track 16 through its bottom load point, thus securing the panel in place.

The side tracks are mounted by fasteners to the exterior of a building. Each track pair is parallel and vertically (or horizontally) connected to a building exterior next to an opening to be protected. In one embodiment, each track has a C-shaped hem channel to receive a hem and hem cord. Each track is U-shaped on the outer edge with a fastener hole that receives a fastener to permanently mount the track to the building exterior surface. The parallel tracks can be vertical or horizontal depending upon the direction the panel is to be mounted.

To install a flexible hurricane panel from the inside of a building, the installer opens the window so that the installer has access to the segmented linear, parallel, vertical panel securing tracks on each side of the open window. The installer inserts the top of the panel's hems into the upper track hem chambers and via each track bottom load point. The installer then uses the long hand-straps 22 to slide the panel in an upward direction until the panel reaches the uppermost portion of the track. The installer would then insert the panels bottom hem into the hem chamber 16*c* and 18*c* via the bottom tracks load point. The panel 20 is then pushed down into the lower vertical, parallel track segments and again using the straps 22 to force the panel downwardly until the bottom end of the panel reaches the end of the tracks. The installer then inserts each locking pin 32 into each track (a pin-marker identifies the location of the pin-slot on each track). The installer inserts the locking pin 32 on each side thereby locking the panel 20 in place. The window can then be closed. To remove the panel the installer reverses the process by removing the locking pins and sliding the ends of the panel to the middle, removing the panel.

What I claim is:

1. A protective panel for storm, security, insect or solar purposes that can be mounted over a window, door, or wall opening from either the inside or outside of a building comprising:

a single pliable body panel, substantially rectangularly-shaped and sized to cover a building window; said pliable body panel having a pair of parallel sides, each parallel side having a separated upper and lower hem which affixes a respective separated upper and lower hem cord to each side of said body panel and each upper and lower hem and hem cord on each side separated by a respective pin-slot; and a pair of body panel mounting and securing hem tracks sized to engage each of upper and lower hems in a respective hem track's hem chamber, said hem tracks being mountable on the exterior of the building adjacent an a opening to be protected and spaced apart to receive and secure said body panel over the building opening; and at least one locking pin engageable with at least one of said pair of body panel mounting and securing hem tracks within the pin-slot on each side of said body panel; each said pin-slot made to allow access to the at least one locking-pin from either one or both sides of the body panel; said locking pin once in its locked position, restricts at least one panel's upper and lower hem and hem cord sliding movement relative to said pair of body panel mounting and securing hem tracks.

2. A protective panel as in claim 1, wherein: said body panel is made of a hurricane resistant polyester fabric.

3. A protective panel as in claim 1 including:

at least one elongated, hand-strap fastened to one side of said body panel either extending from one end of the body panel to an opposite end of the body panel or placed at intervals that can be used for manually sliding said body panel along a track hem chamber; said hand strap oriented in any direction that suits the opening body panel installation.

4. The protective panel in claim 1 including:

one or more hand-straps of a pliable material attached to one side of said body panel for manually carrying or assisting in the manipulating said body panel during installation or removal.

5. A protective panel as in claim 1 including: a tether for said at least one locking-pin for said body panel that is used to immobilize the storm panel at a pre-determined location within the said pair of body panel mounting and securing hem tracks once the at least one locking-pin is in its locked position.

6. A protective panel as in claim 1 including: each said pin-slot positioned at any location along said pair of body panel mounting and securing hem tracks.

7. A protective panel as in claim 1 including: said pliable body panel is installed into said pair of body panel mounting and securing tracks at any pre-determined location along said pair of body panel mounting and securing tracks.

8. A protective panel as in claim 1 including: said pair of body panel mounting and securing hem tracks with hem chambers are each configured as a single track with a respective screen loading point located at the end of each one of said pair of body panel mounting and securing hem tracks.

9. A protective panel as in claim 1 including: said pair of body panel mounting and securing hem tracks with hem chambers are each configured as two single tracks, separated by a space, that are aligned in such a way that each of the tracks load in points is facing the other separated track's load in point.

10. A protective panel as in claim 1 including: said pair of body panel mounting and securing tracks with hem chambers are each configured as a single track that has a segmented opening as to provide a gap with two opposing load in points.

11. A protective panel as in claim 1 including: locations of said at least one locking pin on said at least one of said pair of body panel mounting and securing hem tracks are each identified by a marker physically placed on said at least one of said pair of body panel mounting and securing hem tracks.

12. A protective panel as in claim 1 including: locations of said at least one locking pin are each identified by a marker physically placed on the pliable body panel and a relative location of the locking pin slot within said at least one of said pair of body panel mounting and securing hem tracks.

* * * * *